US005662078A

United States Patent [19]

Adegawa

[11] Patent Number: 5,662,078

[45] Date of Patent: Sep. 2, 1997

[54] INTAKE VALVE DEVICE FOR PREVENTING ADHESION OF DEPOSITS

[75] Inventor: Makoto Adegawa, Kawasaki, Japan

[73] Assignee: Fuji Oozx Inc., Japan

[21] Appl. No.: 629,196

[22] Filed: Apr. 8, 1996

[30] Foreign Application Priority Data

Oct. 26, 1994 [JP] Japan ..... 6-262481

[51] Int. Cl.[6] ..... F01L 3/04; F01L 3/08

[52] U.S. Cl. ..... 123/188.3; 123/188.9

[58] Field of Search ..... 123/188.2, 188.3, 123/188.9

[56] References Cited

U.S. PATENT DOCUMENTS

| | | | |
|---|---|---|---|
| 1,569,455 | 1/1926 | Burwell | 123/188.9 |
| 3,037,494 | 6/1962 | Kirkpatrick | 123/188.9 |
| 3,581,728 | 6/1971 | Abraham | 123/188.9 |
| 3,809,046 | 5/1974 | Kammeraad | 123/188.9 |
| 3,828,756 | 8/1974 | Kammeraad et al. | 123/188.9 |
| 4,103,662 | 8/1978 | Kammeraad | 123/188.9 |
| 4,465,040 | 8/1984 | Pelizzoni | 123/188.9 |
| 4,706,967 | 11/1987 | Ochsner | 123/188.9 |
| 4,768,479 | 9/1988 | Kammeraad | 123/188.9 |
| 5,465,691 | 11/1995 | Capaldo | 123/188.9 |

*Primary Examiner*—Erick R. Solis

*Attorney, Agent, or Firm*—Zarley, McKee, Thomte, Voorhees, & Sease

[57] ABSTRACT

An intake valve in an internal combustion engine comprises a valve stem and a valve head and moves up and down. On either of contact surfaces between the valve stem and a valve guide, annular and elongate grooves are formed to communicate with an intake port at the lower end. Lubricating oil invaded into a gap between the valve stem and the valve guide goes down through the grooves, gets out of the valve guide and adhere onto the valve head in the intake port. The oil on the valve head is washed down by fuel injected from a fuel injector.

8 Claims, 3 Drawing Sheets

INTAKE VALVE DEVICE FOR PREVENTING ADHESION OF DEPOSITS

BACKGROUND OF THE INVENTION

The present invention relates to an intake valve device for preventing adhesion of deposits.

In poppet valves in engines of automobiles and ships, especially, in intake valves which has relatively low heat load, if high boiling point organic substances in lubricating oil leaked from a gap between a valve guide and a valve stem adhere to a valve head and adjacent area, they will be carbonized at of 200° to 300° C. of the intake valve, gradually aggregated and developed, thereby forming sludges or bulk of deposits. In the deposits, corrosion ingredients may be contained, which causes corrosion in the valve head and adjacent area.

To overcome the disadvantages on the surface of the valve head and adjacent area, an intake valve is suggested as mentioned Japanese Patent Laid-Open Pub. No. 6-235308, wherein a coating layer which has oxidation catalytic function is formed on the valve head and adjacent area, thereby preventing high boiling point organic substances from adhering on the valve head and adjacent area owing to oxidation catalytic reaction thereof. However, in the intake valve in this publication, an engine runs for a long time at low load and speed, so that the surface of catalyst is partially covered with high boiling point organic substances in the lubricating oil owing to oil-down until the intake valve becomes reaction temperature of the catalyst, and the catalyst is blocked against air or oxygen. Thus, oxidization catalytic reaction may not be achieved enough.

SUMMARY OF THE INVENTION

To overcome the disadvantage, it is an object of the present invention to provide a valve device in which oil-down is directed toward a fuel injection device to prevent deposits from adhering to a valve head and adjacent area and catalyst surface from being covered by lubricating oil.

According to one aspect of the present invention, there is provided an intake valve device for preventing adhesion of deposits in an internal combustion engine, the device comprising an intake poppet valve which comprises a valve head and a valve stem; a valve guide in which the valve is slidably inserted; and fuel injection means which injects fuel toward the valve head, either of contact surfaces between the valve stem and the valve guide having an annular groove and an elongate groove which communicates with the annular groove, a lower end of the elongate groove opening toward an intake port in the vicinity of the fuel injection means.

According to another aspect of the present invention there is provided an intake valve device for preventing adhesion of deposits in an internal combustion engine, the device comprising an intake poppet valve which comprises a valve head and a valve stem; a valve guide in which the valve is slidably inserted; and fuel injection means which injects fuel toward the valve head, either of contact surfaces between the valve stem and the valve guide having a spiral groove, a lower end of the spiral groove opening toward an intake port in the vicinity of the fuel injection means.

According to the present invention, lubricating oil owing to oil-down is guided to the valve head through the annular and elongate grooves or the spiral groove and washed down by fuel injected by the fuel injection means, thereby avoiding the lubricating oil from adhering to the intake valve.

BRIEF DESCRIPTION OF THE DRAWINGS

The features and advantages of the invention will become more apparent from the following description with respect to embodiments as shown in appended drawings wherein.

DETAILED DESCRIPTION OF PREFERRED EMBODIMENT

Figure 1:
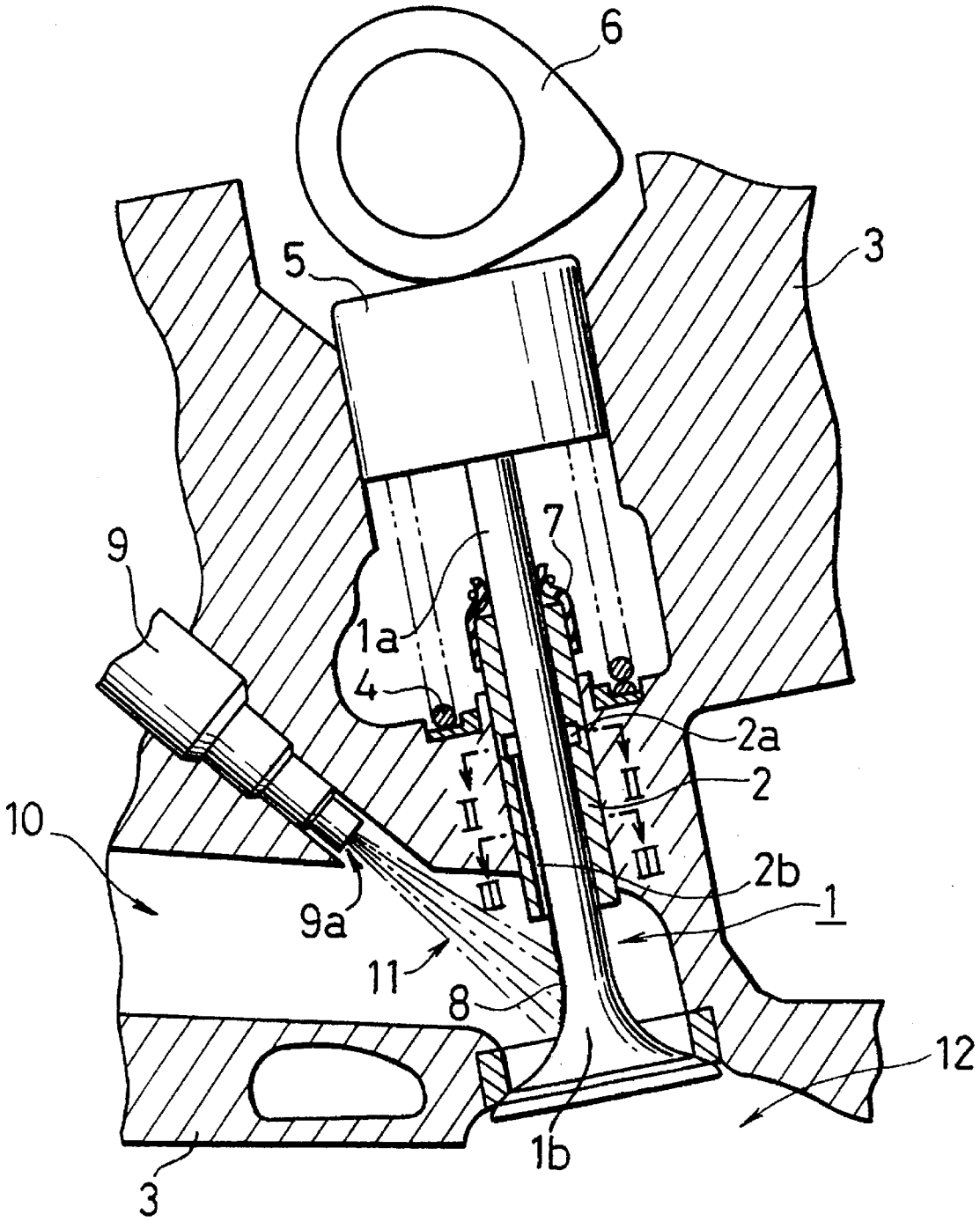
FIG. 1 is a sectional view of the first invention.
Figure 2:
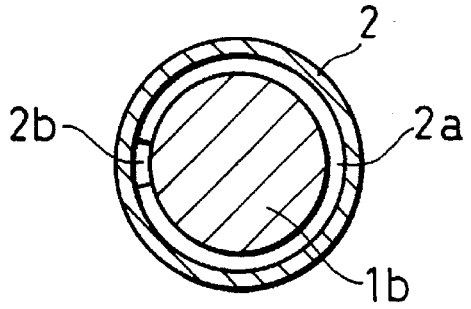
FIG. 2 is an enlarged horizontal sectional view taken along the line II—II in FIG. 1.

The first invention is illustrated in FIG. 1, in which the numeral 1 denotes an intake valve which is molded from martensitic heat resisting steels and which comprises a valve stem 1*a* and and a valve head 1*b* at the lower end thereof. The valve stem 1*a* of the intake valve 1 is slidably inserted in a cylindrical valve guide 2 which is pressed in a cylinder head 3, and the intake valve 1 is moved up and down by pushing the upper surface of a cylindrical tappet 5 at the upper end of the valve stem 1*a* by a cam 6. 4 denotes a valve spring.

At the upper end of the valve guide 2, a lip seal 7 is engaged over the outer circumferential surface of the valve stem 1*a*, thereby preventing excessive lubricating oil 8 from running into a gap between the valve stem 1*a* of the intake valve 1 and the valve guide 2.

Figure 3:
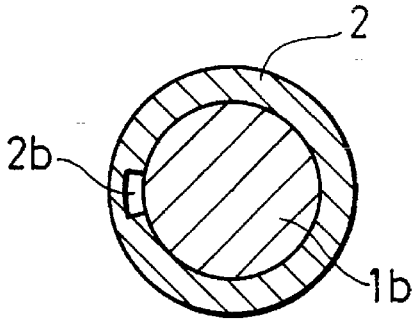
FIG. 3 is an enlarged horizontal sectioned view taken along the line III—III in FIG. 1.
Figure 4:
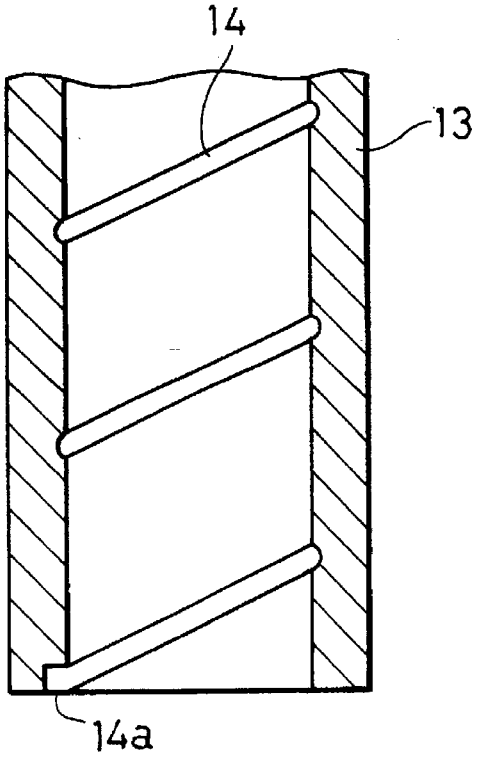
FIG. 4 is an enlarged horizontal sectioned view of of a valve guide of the second invention.

In the vicinity of the intake valve 1, an injector 9 for injecting gasoline in vapour is provided in the cylinder head 3, and an injection port 9*a* is directed to the surface of the valve head 1*b* in the intake port 10. On the surface of the valve guide 2 which contacts the intake valve 1, there is formed an annular groove 2*a* and an elongate groove 2*b* which communicates with the annular groove 2*a* at the upper end and which extends to the lower end of the valve guide 2. The lower end of the elongate groove 2*b* opens toward the intake port 10, which is also shown in FIGS. 3 and 4.

The function of the embodiment as above will be described. The lubricating oil 8 which runs in the gap between the valve stem 1*a* of the intake valve 1 and the valve guide 2 is temporarily held in the annular groove 2*a*. The lubricating oil 8 in the annular groove 2*a* runs into the lower end of the valve stem 1*a* of the intake valve 1 in the intake port 10 and reaches the valve head 1*b* in the vicinity of the injector 9 via the elongate groove 2*a*. The gasoline 11 is blown to the lower end of the valve stem 1*a* of the intake valve 1 and the head 1*b* by the injector 9, so that the lubricating oil 8 which adheres thereon is washed down by the gasoline 11 and sucked into the cylinder 12. Therefore, the lubricating oil 8 hardly adheres on the surface of the intake valve 1 in the intake port 10.

In the above embodiment, the annular groove 2*a* and the elongate groove 2*b* are both formed on the valve guide 2, but may be formed on the intake valve 1.

Preferably, the annular groove 2*a* may be formed as low as possible. So far as the lubricating oil 8 invaded in the gap between the valve guide and the intake valve 1 is held in the annular groove 2*a*, the lubricating oil does not reach the contact surface lower than the annular groove 2*a*. It is for preventing lubrication decrease.

An embodiment of the second invention will be illustrated in FIG. 4. Difference between the above and present embodiments is only a groove in the inner circumferential surface of the valve guide 13, and the other illustration will be omitted. A spiral groove 14 is formed on the whole inner circumferential surface of the valve guide 13, and an opening 14*a* at the lower end of the spiral groove 14 communicates with the intake port 10 in the vicinity of the injector 9 similar to the elongate groove 2*b* in the foregoing embodiment.

The lubricating oil 8 invaded into a gap between the intake valve 1 and the valve guide 13 runs into the spiral groove 14 and reaches the valve head 1*b* of the intake valve 1 in the vicinity of the injector 9 similar to the foregoing embodiment. The oil 8 which adheres on the valve head 1*b* is washed down by the gasoline 11 from the injector 9. This embodiment achieves similar advantage to the foregoing embodiment, and the spiral groove 14 provides excellent oil-maintenance capability compared with the elongate groove 2*b*, and increases lubricating properties of contact surfaces of the intake valve 1 and the valve guide 13.

The spiral groove 14 may be formed from a suitable position on the inner circumferential surface of the valve guide 13 to the lower end of the valve guide 13. The spiral groove 14 may be formed on the intake valve 1.

Figure 5:
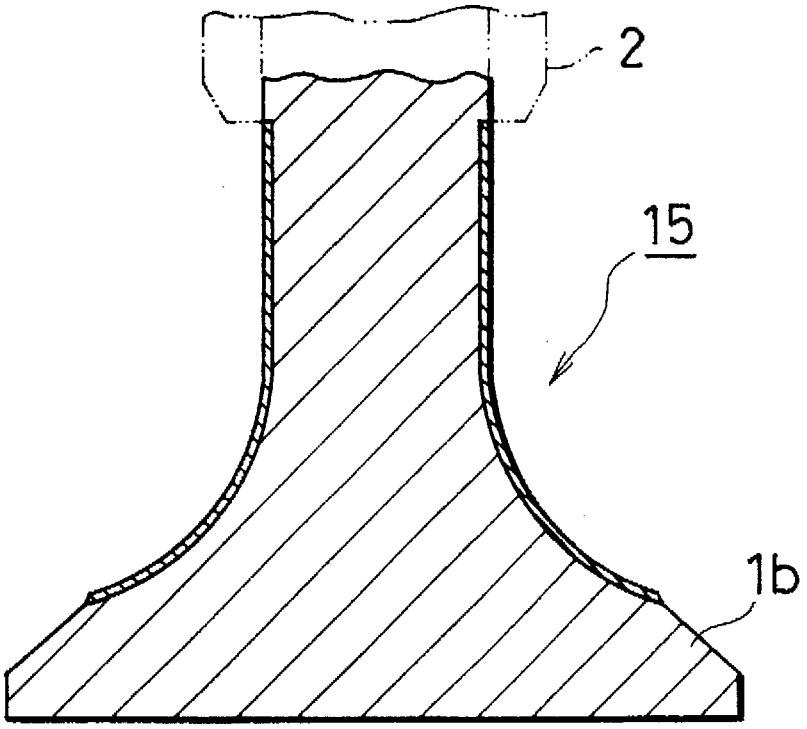
FIG. 5 is an enlarged vertical sectioned view of an embodiment of the present invention.
Figure 6:
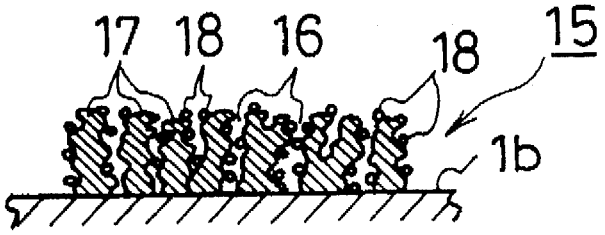
FIG. 6 is an enlarged view of a coating layer.

Another embodiment of the present invention will be illustrated in FIG. 5, in which a coating layer having oxidation catalytic function is formed on a portion of the intake valve 1 in the intake port 10, i.e. on the lower end of the valve stem 1*a* and the head 1*b* on which high boiling point organic substance is likely to adhere. As enlarged in FIG. 6, the surface of the intake valve 1 is coated with ceramic porous carrier 17 having a limitless number of micropores 16, into which active substances such as Pt, Pd and Rh are dissolved and carried, thereby forming the coating layer 15. The porous carrier 17 may be preferably made of oxide ceramics such as $Al_2O_3$, $ZrO_2$ and cordierite, and may be coated by surface treatment means such as thermal spray and coating. If the surface of the intake valve 1 is made rough, peeling resistance of the porous carrier 17 will be increased. If the porous carrier 17 comprises two layer structure which comprises treating layer of $Al_2O_3$ and wash-coat layer of $\gamma$-$Al_2O_3$ applied thereon, the surface area of the micropores 16 will become larger, thereby increasing carrying capability of the active substance.

The high boiling point organic substance included in the lubricating oil 8 which is not washed down by the gasoline 11 and in the lubricating oil 8 which is scattered by up-and-down movement of the intake valve 1 onto the opposite surface of the valve head 1*b* in the vicinity of the injector 9 is absorbed on the active substance 18 in the coating layer 15. When the intake valve 1 becomes a predetermined temperature of 200° to 350° C., oxidation catalytic reaction occurs from heated portion, thereby leaving the high boiling point organic substance from the active substance 18 and dispersing it, so that high boiling point organic substance is neither carbonized nor deposited on the surface of the valve head 1*b*.

The present invention may be applied to internal combustion engines other than gasoline engine.

The foregoings merely relate to preferred embodiments of the invention. Various changes and modifications may be made by person skilled in the art without departing from the scope of claims wherein:

What is claimed is:

1. An intake valve device for preventing adhesion of deposits in an internal combustion engine, the device comprising:

an intake poppet valve which comprises a valve head and a valve stem;

a valve guide in which the valve stem is slidably inserted; and fuel injection means which injects fuel toward the valve head, either of contact surfaces between the valve stem and the valve guide having an annular groove and an elongate groove which communicates with the annular groove, a lower end of the elongate groove opening toward an intake port in the vicinity of the fuel injection means.

2. An intake valve device as defined in claim 1 wherein the annular and elongate grooves are formed on the contact surface of the valve guide to the valve stem.

3. An intake valve device as defined in claim 1 wherein the annular groove is formed at lower portion at the contact surface of the valve guide.

4. An intake valve device as defined in claim 1 wherein the deposits comprise lubricating oil invaded into a gap between the valve stem and the valve guide.

5. An intake valve device as defined in claim 1 wherein a coating layer having oxidation catalytic function is formed on at least portion of the intake valve in the intake port.

6. An intake valve device for preventing adhesion of deposits in an internal combustion engine, the device comprising:

an intake poppet valve which comprises a valve head and a valve stem;

a valve guide in which the valve is slidably inserted; and fuel injection means which injects fuel toward the valve head, either of contact surfaces between the valve stem and the valve guide having a spiral groove, a lower end of the spiral groove opening toward an intake port in the vicinity of the fuel injection means wherein a coating layer having oxidation catalytic function is formed on at least a portion of the intake valve in the intake port.

7. An intake valve device as defined in claim 6 wherein the spiral groove is formed on the contact surface of the valve guide to the valve stem.

8. An intake valve device as defined in claim 6 wherein the deposits comprise lubricating oil invaded into a gap between the valve stem and the valve guide.

* * * * *